US011998097B2

(12) United States Patent
Spoorendonk et al.

(10) Patent No.: US 11,998,097 B2
(45) Date of Patent: Jun. 4, 2024

(54) HAIR STYLING DEVICE

(71) Applicant: KONINKLIJKE PHILIPS N.V., Eindhoven (NL)

(72) Inventors: Wouter Hendrik Cornelis Spoorendonk, Deventer (NL); Ype Bernardus Brada, Drachten (NL); Nikolaj Vasiljevitsj Zjiroecha, Leeuwarden (NL); Laurentine Costecalde, Amsterdam (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 283 days.

(21) Appl. No.: 16/644,532

(22) PCT Filed: Aug. 28, 2018

(86) PCT No.: PCT/EP2018/073058
§ 371 (c)(1),
(2) Date: Mar. 5, 2020

(87) PCT Pub. No.: WO2019/048285
PCT Pub. Date: Mar. 14, 2019

(65) Prior Publication Data

US 2020/0187619 A1 Jun. 18, 2020

(30) Foreign Application Priority Data

Sep. 10, 2017 (EP) ..... 17190269

(51) Int. Cl.

| | |
|---|---|
| ***A45D 2/00*** | (2006.01) |
| ***A45D 1/04*** | (2006.01) |
| ***A45D 1/08*** | (2006.01) |

(52) U.S. Cl.
CPC ..... *A45D 2/001* (2013.01); *A45D 1/04* (2013.01); *A45D 1/08* (2013.01); *A45D 2200/205* (2013.01)

(58) Field of Classification Search
CPC .... A45D 2200/205; A45D 2/001; A45D 1/04; A45D 1/08
See application file for complete search history.

(56) References Cited

U.S. PATENT DOCUMENTS 6,026,821 A * 2/2000 Last ..... A45D 20/12 132/211
8,424,543 B2 * 4/2013 Lombardi ..... A45D 20/12 132/271

(Continued)

FOREIGN PATENT DOCUMENTS

EP 2861096 8/2016
EP 3216368 9/2017

(Continued)

OTHER PUBLICATIONS

International Search Report and Written Opinion dated Oct. 16, 2018 For International Application No. PCT/EP2018/073058 Filed Aug. 28, 2018.

*Primary Examiner* — Rachel R Steitz
*Assistant Examiner* — Brianne E Kalach

(57) ABSTRACT

In a hair styling device (20) having a two-dimensional array (21) of elements to bring hair at a styling temperature, the elements produce optical radiation energy. The elements may include one or more LEDs, and preferably a plurality of LEDs, in which case the LEDS are driven in clusters that may be of mutually different shapes and sizes. The hair styling device (20) further comprises sensors to obtain an areal light absorption measurement opposed to the two-dimensional array of elements, and a control unit for individually controlling the elements in dependence of the (Continued)

measurement. The sensors may be arranged for measuring an areal light density profile of a whole treatment area. The hair styling device may radiate hair from two sides, both of which includes an areal light absorption measurement. The sensors may include LEDs that do not produce light.

20 Claims, 3 Drawing Sheets

(56) References Cited

U.S. PATENT DOCUMENTS

| | | | | |
|---|---|---|---|---|
| 2010/0132733 | A1* | 6/2010 | Kyu | A45D 2/36<br>132/229 |
| 2015/0173480 | A1 | 6/2015 | Washington | |
| 2019/0343258 | A1 | 11/2019 | Palero | |
| 2020/0146413 | A1* | 5/2020 | Mathiaszyk | A45D 2/001 |

FOREIGN PATENT DOCUMENTS

| | | |
|---|---|---|
| GB | 2477834 | 8/2011 |
| WO | 2005/079620 | 9/2005 |
| WO | 2011/010239 | 1/2011 |
| WO | 2013/142497 | 9/2013 |
| WO | 2015/094839 | 6/2015 |
| WO | 2019/048357 | 3/2019 |
| WO | 2019/048446 | 3/2019 |

* cited by examiner

| | | | | | | | |
|---|---|---|---|---|---|---|---|
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 1 | 1 | 0 |
| 1 | 1 | 1 | 1 | 0 | 1 | 1 | 1 |
| 1 | 1 | 1 | 1 | 0 | 0 | 1 | 1 |
| 1 | 1 | 1 | 1 | 0 | 1 | 1 | 1 |
Fig. 2
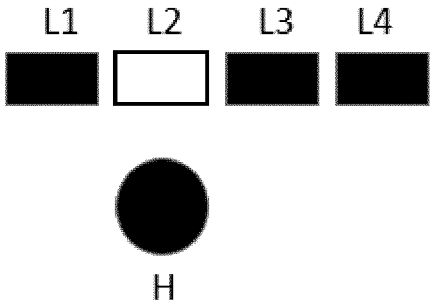
Fig. 3
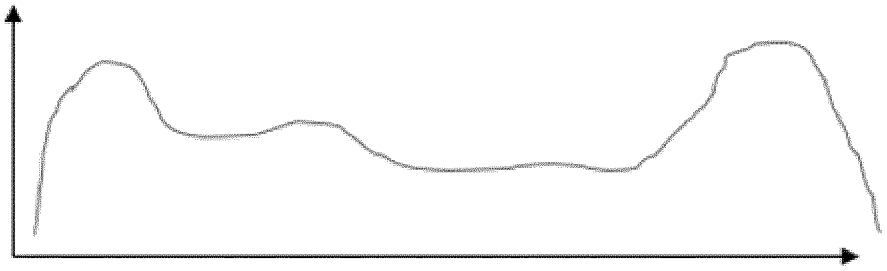
Fig. 4

HAIR STYLING DEVICE

CROSS REFERENCE TO RELATED APPLICATIONS

This application is the U.S. National Phase application under 35 U.S.C. § 371 of International Application No. PCT/EP2018/073058 filed Aug. 28, 2018, published as WO 2019/048285 on Mar. 14, 2019, which claims the benefit of European Patent Application Number 17190269.5 filed Sep. 10, 2017. These applications are hereby incorporated by reference herein.

FIELD OF THE INVENTION

The invention relates to a hair styling device for e.g. hair crimping, curling, perming and straightening.

BACKGROUND OF THE INVENTION

WO2015094839 discloses an appliance for shaping fibrous material where when the appliance is in the closed position, the portion of the fibrous material received between the first inner face and the second inner face can receive light energy from the light source and heat energy from the heating element. In at least one embodiment, the light source comprises at least two arrays of light-emitting diodes, wherein each array is a plurality of light-emitting diodes disposed along at least a portion of the length of the first and/or second arm.

GB2477834 discloses a hair styling appliance comprising at least one heater having a plurality of heating zones. The heating zones are independently operable, and are arranged along the length of the heater. Heating zones may additionally be arranged across the width of the heater. The heater may comprise heating zones arranged along the length and across the width of the heater in a two-dimensional array. The two-dimensional array may have regular or non-regular grid-like formation. The heating means of each heating zone may include one or more of the following heating elements: a heating element comprising thick film printed on ceramic, a heating element comprising thick film printed onto anodized aluminum, a heating element comprising thin film evaporated onto ceramic or anodized aluminum, or a flexi heater or a Kapton heater. A control system includes sensing means, and predicts the intended use of the appliance. The heating zones are then operated accordingly. Control means having feedforward control may include an LED array/photodiodes/photosensor along the edge of a heatable plate to detect the amount and type of hair and adjust the power supply accordingly. For example, fine blond hair has a lower transition temperature and so the heaters require less power. The hair styling appliance may be a hair straightener, curling tong, curling wand or a crimping iron.

EP2861096 discloses a hair shaping device for use for hair shaping comprising a number of radiation sources for hair shaping, and a control device for the emission of radiation.

SUMMARY OF THE INVENTION

It is, inter alia, an object of the invention to provide an improved hair care device. The invention is defined by the independent claims. Advantageous embodiments are defined in the dependent claims.

Hair damage, particularly due to the application of heat, is a major concern of consumers. It is therefore highly desired to style the hair without significant heating of the cuticle of hair.

One aspect of the invention provides a hair styling device having a two-dimensional array of elements to bring hair at a styling temperature, in which the elements produce optical radiation energy. The elements may include one or more LEDs, and preferably a plurality of LEDs, in which case the LEDS are driven in clusters that may be of mutually different shapes and sizes. The hair styling device further comprises sensors to obtain an areal light absorption measurement opposed to the two-dimensional array of elements, and a control unit for individually controlling the elements in dependence of the measurement. The sensors may be arranged for measuring an areal light density profile of a whole treatment area. The hair styling device may radiate hair from two sides, both of which includes an areal light absorption measurement. The sensors may include LEDs that momentarily do not produce light.

Embodiments of the invention differ from GB2477834 in two ways. Firstly, the hairs are measured at and within the treatment area, not upfront before entering the device. This is better since the hair alignment can still change before entering the treatment area. Secondly, light is used to heat the hairs until above a temperature sufficiently high for styling hair (a heat source may be present, but does not provide heat at a temperature above this temperature sufficiently high for styling hair. By using light, a very responsive system is obtained that can be quickly (milliseconds) adjusted to the facing hairs. In GB2477834A the hairs are heated with hot plates. These hot plates have a relative large heat sink and their temperatures can therefore not be changed accordingly within the time the hair faces the hot plate. The temperature adjustment is too slow if hairs pass the treatment area in a much shorter time than the reaction time of the system.

These and other aspects of the invention will be apparent from and elucidated with reference to the embodiments described hereinafter.

BRIEF DESCRIPTION OF THE DRAWINGS

FIG. 2 shows an embodiment of a light exposure unit for use in a hair styling device of the invention;

FIG. 3 illustrates individual driving of elements of the light exposure unit;

FIG. 4 illustrates an areal light absorption measurement; and

DESCRIPTION OF EMBODIMENTS

Figure 1A:
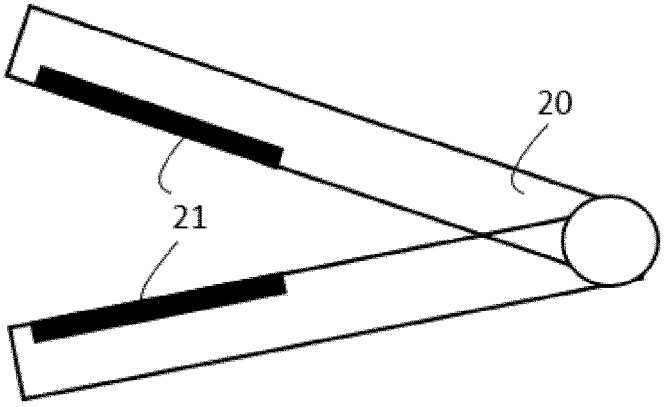
FIGS. 1*a* and 1*b* shows embodiments of a hair styling device in accordance with the present invention, in the form of a hair straightener and a hair curler, respectively.

An embodiment of the invention features a handheld hair styling device of the type disclosed in applicant's earlier application EP3216368, incorporated herein by reference, which comprises:

- a pulse-driven light emitting diode (LED) or an array of LEDs configured to deliver optical energy to hair, wherein:

an output wavelength is in the range 400-900 nm, with good results in the range 400-650 nm, and preferably in the range 450-550 nm, a pulse width is in the range 50-300 ms, preferably between 50 and 200 ms, such as in the range 100-200 ms, or between 50 and 100 ms, a LED pulse driver circuit to drive the LED/s, a control system to control the LED pulse driver, particularly controlling pulse electrical parameters including voltage, pulse duration, and pulse duty cycle, a hair contacting interface configured to contact the hair and hold the hair in a pre-configured shape, e.g. planar, cylindrical, during pulsed light exposure provided by the LED, and an optical shield configured to block stray light during light exposure of hair. The optical shield is configured to provide maximum recycling of light escaping from the hair lock, for instance by configuring the inner surface to be reflective and configured to have a parabolic shape.

A wavelength range between 400 and 900 nm, and preferably between 450 and 550 nm, appears to be the optimal wavelength range for selective heating of the cortex. However, high brightness high efficiency LEDs outputting light in the range between 800 nm to 1000 nm may prove to be a direction for more efficient LEDs. Although at such higher wavelengths, melanin absorption is relatively lower than using lower wavelengths, styling by means of such LEDs emitting light in the range between 800 nm to 1000 nm could be more cost-effective than using high power near infrared LEDs.

The pulse width may be to up to 1.5 s to achieve the required fluence with medium-power LEDs.

A thermal diffusion time constant of hair appears to be between 150 and 200 ms.

In an experiment, a lock of brown hair was wound around a metal rod (diameter 15 mm) to a 132-unit array of 650-nm LEDs with energy fluence of 3 J/cm$^2$ with a pulse width of 100 ms. This resulted in a clear curling effect.

FIG. 1*a* shows an exemplary embodiment of a handheld hair styling device 20 in the form of a hair straightener, which comprises light exposure units 21 with arrays of light-emitting diodes (LEDs) inside.

Figure 1B:
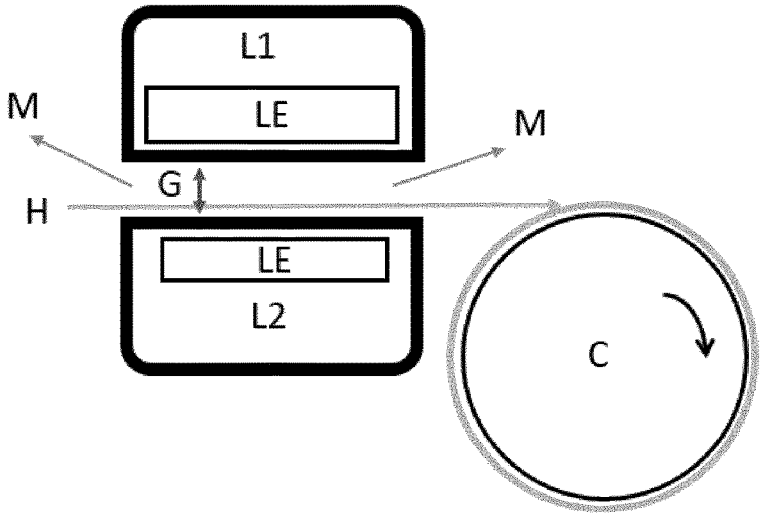

FIG. 1*b* show a possible embodiments of a hair curling device in accordance with the invention. Hair H is guided though a hair treatment area comprising 2 light units L1, L2 each having a respective light engine LE, the light units L1, L2 being spaced apart by a gap G that is sufficiently large to allow moist M to escape from the gap G. As the hair H may have a thickness of about 0.2 mm, the gap should be at least 0.3 mm to allow both hair H and moist M to pass. The gap G should not be too big because otherwise the light intensity will be attenuated too much, so preferably not more than e.g. 5 mm. In view thereof, a gap G between 0.5 and 3 mm would be preferred, such as of about 1-2 mm. After the hair H has been heated as a result of the optical radiation by the light units L1, L2, the hair is wound around a cylinder C so as to apply a curly shape to the hair H. The moist escape feature is described in more detail in a co-pending application EP17190266.1 entitled to the same priority date as the present application, incorporated by reference herein.

If the hairs are not evenly distributed across the treatment area some hairs might absorb too little or too much light. It is an object of embodiments of the present invention to overcome too much or too little light exposure caused by poor alignment of the hairs. This is achieved by areal driving of the LEDs. To generate enough (e.g. >1 W/cm$^2$) optical power, multiple (>3) LEDs in a 2-dimensional plane (not a line row) are preferably used to cover a certain treatment area (>0.5 cm$^2$). An exemplary embodiment is a matrix of 6×8 LEDs, as shown in FIG. 2. In this configuration, the LEDs can be operated in clusters (e.g. rows, columns, or groups of n×m LEDs), or even better per individual light source. This way the treatment intensity can vary (positive and negative) across the whole treatment area. The treatment area may even change in size if some LEDs do not face any hair. In this way, an embodiment substantially uniformly heats a non-homogenous matter (hairs) as a whole to the glass transition state needed to change the shape of the hairs.

FIG. 3 illustrates one possible example of areal driving of the LEDs: elements L1, L3 and L4 are switched off, while element L2 that faces a hair H is switched on.

An embodiment thus provides that the light emitting treatment area includes a two-dimensional plane with different light sources. These light sources are electrically driven per cluster or ideally per individual light source. This way the treatment area size and treatment intensity can vary (positive and negative) across the whole treatment area.

Due to safety, the hairs which are irradiated should be treated within a closed treatment chamber. Out of reach for the naked eye. Next, this invention proposes to perform an areal light absorption measurement, as illustrated in FIG. 4, opposed to the light treatment area within the closed treatment chamber. This way a light intensity profile can be calculated. The higher the intensity measured opposed to the light treatment area the lower the hair density facing the lighting. If no direct light intensity is seen (scattered or reflected photons do not count) all light is blocked and thus fully absorbed in the hairs. With enough sensors a light intensity profile can be obtained. This information will be applied to a control unit for controlling the light sources, and the current of the light clusters can be adjusted accordingly. A locally measured low signal (light intensity) is the result of a high absorption rate at the facing hairs. And vice versa. This information is very valuable to calculate the right areal light intensity need to bring all stacked hair of a certain volume at glass transition.

An embodiment thus provides that an areal light density profile of the whole treatment area of the stacked hair is measured, opposed to the light emitting area, and applied to a control unit for controlling the light sources to adjust the light intensity based on the measured hair density.

Measuring a profile like above needs multiple light sensors (>3, or preferably >10) to gain relevant accuracy. The latter can be difficult to integrate, especially into a double sided illumination system (e.g. a clamp), since the LEDs need to be closely packed for high optical power densities. All space is already occupied by the LEDs. This can be used to advantage. Apart from emitting light when a current is applied to a LED, LEDs also have the property that they generate a current when light is applied to the LED when the LED is not used as a light source. So, if light is absorbed by the diode when it is not used to generate light, an inverse current is generated. This signal can be the readout for the intensity profile. The signal depends on the temperature of the LED but for this we can adjust with a temperature sensor at a single LED. So, an embodiment benefits from the fact that the diodes of the different light sources absorb light when they are not used, as with opposed intense lighting this inversed signal can be the read out of the intensity profiling of the facing hairs, so that no extra sensors are needed in the system. So, in the embodiment of FIG. 1*a*, both light exposure units 21 have the dual function of providing optical radiation energy, and measuring the light radiated from the opposite light exposure unit 21 in the other leg of the hair straightener. The same holds for the light engines LE in the mutually opposed light units L1, L2 in the embodiment of FIG. 1*b*.

Embodiments of the invention thus provide the following features. The light emitting treatment area includes a two dimensional plane (>3×2) with different light sources. These light sources are electrically driven per cluster or ideally per individual light source. This way the treatment area size and treatment intensity can vary (positive and negative) across the whole treatment area. An areal light density profile of the whole treatment area of the stacked hair is measured, opposed to the light emitting area, and applied to a control unit for controlling the light sources to adjust the light intensity based on the measured hair density. The diodes of the different light sources absorb light when they are not used. With opposed intense lighting this inversed signal can be the read out of the intensity profiling of the facing hairs. This way no extra sensors are needed in the system.

Figure 5A:
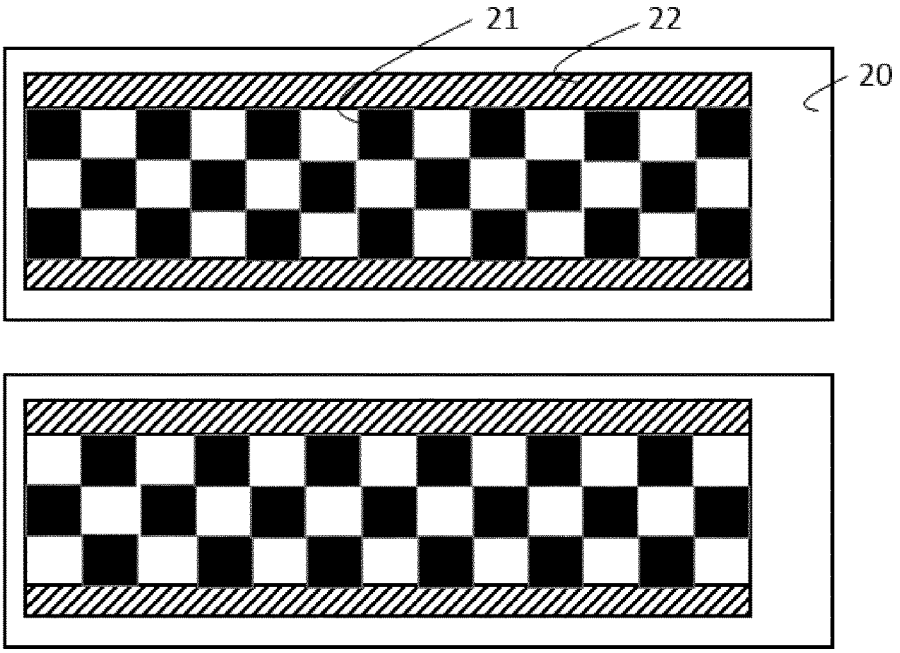
FIGS. 5*a* and 5*b* show alternative configurations of LEDs and sensors for use in a hair styling device of the present invention.
Figure 5B:
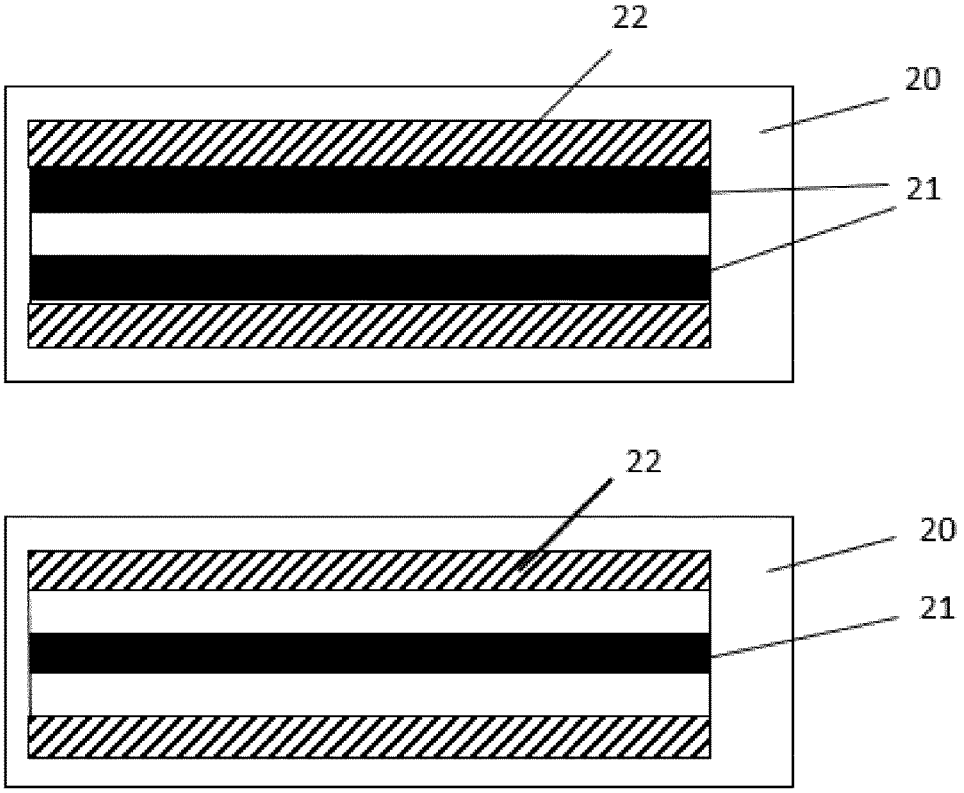

However, in alternative embodiments of the invention, light is only applied from one side to the hair, and sensors are positioned at the other side of the hair. In yet other embodiments, as illustrated in FIGS. 5*a* and 5*b*, LEDs 21 are present in upper and lower light units of a hair styling device 20 (e. the hair straightener of FIG. 1*a* or the hair curler of FIG. 1*b*), in a zone between parts of a heat bridge 22. Between the LEDs 21 shown by means of black squares/stripes, sensors are present in the white squares/stripes. The positions of the LEDs and sensors in the upper and lower light units of the hair styling device 20 are in anti-phase, so that a LED is facing a sensor. The heat bridge feature is described in more detail in a co-pending application EP17190265.3 entitled to the same priority date as the present application, incorporated by reference herein.

An embodiment is based on the consideration that hairs do not have a predefined limit to which they absorb energy, and hairs do easily stack or cross-over other hairs causing an uneven hair distribution. For this reason, the irradiation profile of photo-thermal hair reshaping should be adjusted each time to the stacked hairs facing the light emitting treatment area. Next, hairs from the same person do have different light absorbance behaviors. Therefore, real life areal data of the volume of hairs to be treated is needed. An embodiment thus features a method to map hair density across the treatment area to adjust the irradiance intensity accordingly to the volume of hairs facing the light emitting treatment area.

In an embodiment, the system uses pulsed LEDs to style hair, wherein the output wavelength is preferably in the range between 400 and 900 nm and more preferably in the range between 450 and 550 nm, and the pulse width is preferably shorter than or equal to 200 ms and more preferably shorter than or equal to 100 ms. To prevent the hair from being damaged, the output energy fluence on the hair surface is preferably in the range between 1 J/cm$^2$ and 10 J/cm$^2$, more preferably between 3 J/cm$^2$ and 7 J/cm$^2$, and most preferably between 4 and 6 J/cm$^2$.

As set out in more detail in a co-pending application EP17190265.3 entitled to the same priority date as the present application, incorporated by reference herein, embodiments of the present invention are related to a hair styling device comprising a heat source for heating hair, and an optical radiation source for—in combination with heat from the heat source—heating the hair to a temperature sufficiently high for hair styling, in which the heat source obtains its heat from energy provided by the optical radiation source, and in a preferred embodiment, only from the optical radiation source. Advantageously, the heat source may include a heat sink of the optical radiation source. The optical radiation source may advantageously be covered by a cover that is not fully transparent, whereby optical radiation energy is transformed into thermal energy, the heat source including the cover. The cover may advantageously be largely transparent for wavelengths effective for hair styling, while the cover is largely not transparent for wavelengths less effective for hair styling. Advantageously, the optical radiation source may be covered by a cover that is heated by the heat source.

As set out in more detail in a co-pending application EP17190266.1 entitled to the same priority date as the present application, incorporated by reference herein, embodiments of the present invention are related to a hair styling device comprising a light engine to deliver optical energy to hair, in which the hair styling device is arranged to allow moist escaping from the hair in response to optical energy being applied to the hair, to escape from the hair styling device. Preferably, the light engine is the sole energy source for hair styling. A ventilator may move the moist away from the light engine. A processor may control the light engine, in which case the ventilator may also serve to cool the processor and/or the light engine. The hair styling device may comprise clamping members arranged for allowing hair to be guided between and styled by the clamping members, at least one of the clamping members being provided with the light engine. At least one of the clamping members may be provided with openings for allowing moist to escape, or with openings for allowing air to enter so as to convey the moist out of the hair styling device. The clamping members may have non-conforming shapes to allow the moist to escape from the hair styling device. A hair treatment area comprising the light engine may have a gap through which the hair can be guided, the gap being sufficiently wide to allow the moist to escape. A width of the gap may be between 0.3 and 5 mm, and preferably between 1 and 2 mm.

As set out in more detail in a co-pending application EP17190268.7 entitled to the same priority date as the present application, incorporated by reference herein, embodiments of the present invention are related to a hair styling device that comprises an optical radiation source for radiating hair, a sensor unit for measuring effects from radiating hair, and a feedforward control device for controlling the optical radiation source in dependence on a signal from the sensor unit. The optical radiation source may produce a first flash having a first energy density that may be lower than required for photo-thermal hair reshaping, the optical radiation source being controlled to produce a subsequent flash in dependence on a sensor signal obtained in response to the first flash, which subsequent flash may have at least the first energy density. The sensor unit may include a sensor arranged before the optical radiation source in a hair flow direction. The hair styling device may comprise, along a direction in which the hair is guided, a first sensor, a first LED unit being controlled in dependence on a signal from the first sensor, a second sensor, and a second LED unit being controlled in dependence on a signal from the second sensor. The direction in which hair is guided through the hair styling device may determine which part of the optical radiation source will act as the first LED unit. The hair styling device may comprise a drive mechanism to move the hair along the optical radiation source at a speed controlled by the feedforward control device in dependence on the signal from the sensor unit.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The control unit for controlling the optical radiation units of the invention may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims that do not refer to one another does not indicate that a combination of these measures cannot be used to advantage.

The invention claimed is:

1. A hair styling device, comprising:

a two-dimensional array of elements to heat hair, wherein the elements are opposed to each other and are configured to produce optical radiation energy;

sensors to obtain an areal light density profile of a treatment area within a gap between the two-dimensional array of elements;

and a control unit for controlling each of the elements of the two-dimensional array of elements individually in dependence of a sensed hair density measurement such that intensity of the optical radiation energy output is adjusted based on output from the control unit.

2. The hair styling device as claimed in claim 1, wherein the sensors are arranged for measuring an areal light density profile of the whole treatment area.

3. The hair styling device as claimed in claim 2, wherein a treatment intensity varies across the whole treatment area.

4. The hair styling device as claimed in claim 1, comprising two two-dimensional arrays of elements to radiate hair from two sides, both of which include sensors to obtain an areal light absorption measurement.

5. The hair styling device as claimed in claim 1, wherein the sensors include pulse-driven LEDs.

6. The hair styling device as claimed in claim 1, wherein the radiation energy is within a wavelength range of 400 nm and 900 nm.

7. The hair styling device as claimed in claim 1, wherein the sensors include LEDs that output light within a range of 800 nm to 1000 nm.

8. The hair styling device as claimed in claim 1, wherein the sensors are electrically driven in rows or columns, or per individual light source.

9. The hair styling device as claimed in claim 1, wherein the gap is at least 0.3 mm.

10. A hair styling device, comprising:

a two-dimensional array of elements to heat hair, wherein the elements are opposed to each other and are configured to produce optical radiation energy;

sensors to obtain an areal light density profile of a treatment area opposed to the two-dimensional array of elements;

and a control unit for controlling each of the elements of the two-dimensional array of elements individually in dependence of a sensed hair density measurement such that intensity of the optical radiation energy output is adjusted based on output from the control unit.

11. The hair styling device as claimed in claim 10, wherein the sensors are arranged for measuring an areal light density profile of the whole treatment area.

12. The hair styling device as claimed in claim 11, wherein a treatment intensity varies across the whole treatment area.

13. The hair styling device as claimed in claim 10, wherein the sensors include LEDs that output light within a range of 800 nm to 1000 nm.

14. The hair styling device as claimed in claim 10, wherein the sensors are electrically driven in rows or columns, or per individual light source.

15. A hair styling device, comprising:

a two-dimensional array of elements to heat hair, wherein the elements are opposed to each other and are configured to produce optical radiation energy;

sensors to obtain an areal light density profile of a treatment area opposed to the two-dimensional array of elements, wherein the sensors include pulse-driven LEDs that are arranged in a mutually opposed configuration;

and a control unit for controlling each of the elements of the two-dimensional array of elements individually in dependence of a sensed hair density measurement.

16. The hair styling device as claimed in claim 15, wherein the sensors are arranged for measuring an areal light density profile of the whole treatment area.

17. The hair styling device as claimed in claim 16, wherein a treatment intensity varies across the whole treatment area.

18. The hair styling device as claimed in claim 15, wherein the radiation energy is within a wavelength range of 400 nm and 900 nm.

19. The hair styling device as claimed in claim 15, wherein the sensors include LEDs that output light within a range of 800 nm to 1000 nm.

20. The hair styling device as claimed in claim 15, wherein the sources are electrically driven in rows or columns, or per individual light source.

* * * * *